US005085294A

United States Patent [19]

Iwata

[11] Patent Number: 5,085,294

[45] Date of Patent: Feb. 4, 1992

[54] ELEVATOR CONTROL APPARATUS

[75] Inventor: Shigemi Iwata, Inazawa, Japan

[73] Assignee: Mitsubishi Denki Kabushiki Kaisha, Tokyo, Japan

[21] Appl. No.: 528,844

[22] Filed: May 25, 1990

[30] Foreign Application Priority Data

May 29, 1989 [JP] Japan ..... 1-132848

[51] Int. Cl.[5] ..... B66B 3/02

[52] U.S. Cl. ..... 187/134; 187/109; 187/105

[58] Field of Search ..... 187/1 R, 136, 134

[56] References Cited

U.S. PATENT DOCUMENTS 4,096,925 6/1978 Koob et al. ..... 187/1 R
4,671,391 6/1987 Sasao ..... 187/134
4,716,517 12/1987 Iwata ..... 364/148
4,742,894 5/1988 Ujihara ..... 187/136

*Primary Examiner*—A. D. Pellinen
*Assistant Examiner*—Lawrence Colbert
*Attorney, Agent, or Firm*—Leydig, Voit & Mayer

[57] ABSTRACT

An elevator control apparatus comprises drive device for driving an elevator car and a pulse generator, which is connected to the drive device and which generates pulses, the number of which are proportional to the travel distance of the car. The apparatus also comprises computing device for present car position for computing the present position of the car by counting the number of pulses from the pulse generator, computing device for predicted stop position for computing a predicted stop position of the car in case of a power failure during the travel of the car, first memory for storing data of the predicted stop position of the car and for maintaining that data, and second memory for previously storing position data of each floor in relation to an elevator. The elevator control apparatus further includes control device for controlling the drive device based on the present position of the car and the data stored in the second memory, and computing device for correcting car position at power failure for correcting, upon recovery from the power failure, based on the data stored in the first memory and the second memory, the present position of the car, which is computed by the computing device for present car position before the power failure occurs.

5 Claims, 13 Drawing Sheets

ELEVATOR CONTROL APPARATUS

BACKGROUND OF THE INVENTION

1. Field of the Invention

This invention relates to an elevator control apparatus. More particularly, it relates to an elevator control apparatus, which accurately computes the present position of an elevator car even if a power failure occurs while the car is traveling.

2. Description of the Related Art

A number of microcomputers and LSIs have been put on the market because of their technological development in recent years. They are available at low price and are applied to elevator control apparatuses. These microcomputers and LSIs have been utilized as detecting devices and as arithmetic units to compute the present position of an elevator car. The biggest disadvantage of such a detecting device as compared with conventional mechanical detecting devices is that it is not capable of computing the present position of the car if a power failure should occur.

A conventional elevator control apparatus will now be described with reference to FIGS. 8 to 13. FIG. 8 is a view showing an overall configuration of the conventional elevator control apparatus. As shown in FIG. 8, a counterweight 12 is engaged with one end of a rope 13 and a car 11 is engaged with the other end of the rope 13. The counterweight 12 and the car 11 are suspended from a sheave 14, which is driven by a motor 15. Pulses are generated from a pulse generator 16 connected to the motor 15, and are transmitted to a counter circuit 17. A signal 17*a* is transmitted from the counter circuit 17 to a microcomputer 18 in order to undergo the processes required. Power is fed from a power supply 19 to an elevator control apparatus 10, which comprises such components as the motor 15, the pulse generator 16, the counter circuit 17 and the microcomputer 18. Numeral 20 indicates a plate. A first position detecting device (DZD) 21 and a second position detecting device (DZU) 22 are attached to the car 11. Output signals 21*a*, 22*a* of the first and second position detecting devices 21, 22 are respectively transmitted to both the counter circuit 17 and the microcomputer 18. Numeral 23 indicates a fixed floor and numeral 24 indicates the bottom floor. Numeral 25 indicates a bottom floor detecting device. An output signal 25*a* is transmitted from the bottom floor detecting device 25 to the microcomputer 18. Numeral 26 indicates a cam attached to the car 11.

In the conventional apparatus as described above, the information about the traveling distance of the car 11 is transmitted from the sheave 14 to the motor 15 and further to the pulse generator 16. Pulses proportional to the traveling distance of the car 11 are generated from the pulse generator 16. These pulses are counted by the counter circuit 17 and transmitted to the microcomputer 18 as the signal 17*a*. The microcomputer 18 computes, based on the received signal 17*a*, the present position of the car The microcomputer 18 performs required computations at regular operation intervals, for example, every 50 ms. The microcomputer 18 computes not only the present position of the car 11 but also sequence controls, which are required for general operations, such as for controlling calls from aprons or from inside the car 11 and for opening and closing the door of the elevator.

The microcomputer further computes speed control of the motor 15 and so on.

Information about the present position of the car 11 is essential to controlling the elevator. The information is necessary to compute the remaining distance from the present position of the car 11 to the floor where the request for the elevator is made. It is also required for generating the command signal for a rated speed to that floor. The information further controls various indicators within the car 11 and at the aprons.

FIG. 9 is a block diagram showing the inside configuration of the microcomputer 18. As shown in FIG. 9, a CPU 91, an input port 92, an output port 93, a ROM 94 and RAM 95 are interconnected through a bus 97. A backup power supply 96, having an appropriate battery, is connected to the RAM 95.

The ROM 94, in the microcomputer 18 configured as above, stores a program for operating the elevator, a program for controlling the motor 15 speed, a program for computing the present position of the car 11, etc. The signal 17*a* from the counter circuit 17, the signal 21*a* from the first position detecting device (DZD) 21, the signal 22*a* from the second position detecting device (DZU) 22 and the signal 25*a* from the bottom floor detecting device 25 are respectively transmitted to the input port 92. FIG. 10 shows formats of the RAM 95, when a building has floors from the zero-th floor (the bottom floor) to the N−1st floor (the highest floor). For example, in the case where I=0 to N−1, FLHD(I) and FLHU(I) in areas 31, 32 indicate the point when the first position detecting device (DZD) 21 and the second position detecting device (DZU) 22 respond on the I-th floor. FLHL(I) in an area 33 indicates the addition average of the two points FLHD (I) in the area 31 and FLHU(I) in the area 32.

That is, $$FLHL(I)=\tfrac{1}{2}[FLHD(I)+FLHU(I)]$$

where, FLHD(I) and FLHU(I) correspond respectively to an integration value of the number of pulses, which are generated from the pulse generator 16, when the car is hoisted up from the bottom floor, which is the standard floor for computation.

SYNC in an area 34 indicates the present position of the car with the number of pulses from the pulse generator 16. For example, if one pulse is generated from the pulse generator 16 every time the car travels a distance of 1 mm, the SYNC value is 12,385 when the moving car reaches 12,385 mm from the bottom floor.

FSY in an area 35 indicates the present floor of the car in relation to all the floors of the building. For instance, if the building has N floors, the FSY will have a value of from 0 to N−1.

FIG. 11 is a view showing the correlation among a floor level 11B, a position point 11A corresponding to FLHD and a position point 11C corresponding to FLHU for each floor. In this embodiment, an operation point for output from the second position detecting device (DZU) 22 lies within the range from 150 mm below floor level to 250 mm above floor level, and an operation point for output from the first position detecting device (DZD) 21 lies within the range from 250 mm below floor level to 150 mm above floor level.

FIG. 12 is a flowchart explaining the execution of a program stored in the ROM 94 in FIG. 9. Logical steps in the process of computing the present position of the car are shown. In this FIG. 12, DP indicates the number of pulses to be input to the microcomputer 18. For example, when the microcomputer 18 is computing with a period of 50 ms, the DP indicates the number of pulses, which are input through the route from the pulse generator 16 to the counter circuit 17 and further to the microcomputer 18 within this period of 50 ms.

The logical sequence, needed for the execution of the program stored in the RAM 94, will now be described with reference to FIG. 12. In step S121, the sequence decides whether the car 11 is in motion or not. If the car 11 is in motion, the sequence goes down to step S122, where the sequence decides whether the car 11 is traveling upward or downward. If the car 11 is traveling upward, the sequence goes to step S123, and if the car 11 is traveling downward, the sequence goes to step S126.

In the step S123, the present position SYNC of the car 11 can be computed with the following operation expression:

$$SYNC \leftarrow SYNC + DP$$

In step S124, the sequence decides, with the following operation expression, whether the car 11 has traveled past a position, midway between two floors:

$$SYNC \geqq (\tfrac{1}{2})[FLHL(FSY) + FLHL(FSY+1)]$$

If the car 11 has traveled past that position, the present floor FSY of the car 11 is updated in step S125 as follows:

$$FSY \leftarrow FSY + 1$$

But if in step S122, where the sequence decides whether the car 11 is traveling upward or downward, the car 11 is found to be traveling downward, the sequence goes to step S126, and the present position SYNC of the car 11 is updated in the following operation expression:

$$SYNC \leftarrow SYNC - DP$$

In step S127, the sequence decides, with the following operation expression, whether the car 11 has traveled past a position midway between two floors:

$$SYNC < (\tfrac{1}{2})[FLHL(FSY-1) + FLHL(FSY)]$$

If the car 11 has traveled past that position, the present floor FSY of the car 11 is updated in step S128 as follows:

$$FSY \leftarrow FSY - 1$$

As shown in FIG. 13, the car 11 starts moving at time T0, then accelerates, and travels at a constant speed at the time T1 onward. At time T2 a power failure for some reason. Owing to this power failure occurs, the car 11 reduces its speed after time T2 and stops at time T3. Whereas, a power feed to the elevator control apparatus is also cut off at time T2. As a result, the operations immediately stop for the pulse generator 16, the counter circuit 17 and the microcomputer 18, all of which are essential to the elevator control apparatus. Therefore, the distance, which the car 11 travels between the two points time T2 and T3, does not affect the computation for the present position of the car 11. That is, more specifically, the distance, corresponding to the shaded portion in FIG. 13, between time T2, when the power failure occurs, and T3, when the car 11 stops, does not affect the computation for the present position of the car 11. For this reason, even if a SYNC value, corresponding to the present position of the car 11 prior to the power failure, is stored in the RAM 95, which is supported with the backup battery power supply 96, the SYNC value has error, by the amount shown in the shaded portion of FIG. 13, at the recovery from the power failure.

Consequently, such a conventional elevator control apparatus is so constructed that the car 11 travels down to the bottom floor for a time. A fixed speed reduction apparatus for the bottom floor controls the speed reduction when the car 11 travels towards the bottom floor. Once the car 11 reaches the bottom floor, the bottom floor detecting device 25 shown in FIG. 8 engages the cam 26 of the car 11. A signal responding to this engagement is transmitted to the microcomputer 18. The followings are performed to correct the present position of the car 11 and the present floor where the car 11 rests.

$$SYNC \leftarrow FLHL(0)$$

$$FSY \leftarrow 0$$

As is recognized from the above-described reasons, the conventional elevator control apparatus has the following problems:

(1) Once a power failure occurs, error exists in the information about the present position of the car and the floor where the car rests at the recovery of the power failure.

(2) To compensate for the error, the car should travel down to a standard floor (for example, the bottom floor) for a time. On the standard floor, the computation is performed for the information about the position of the car and the floor where the car was at the time of the power failure in order to correct this information. For this reason, even at the time of recovery from the power failure, the elevator is not put back into normal service, and is forced to travel down to the standard floor.

(3) In case of a power failure during the travel of the car, an expensive backup power supply is required to stop the car completely.

SUMMARY OF THE INVENTION

It is an object of the present invention to overcome the above-described problems in the conventional apparatus and to provide an elevator control apparatus, which permits the accurate computation for the present position and floor, where the car stops, at the time of a power failure, without travel of the car to the standard floor.

An elevator control apparatus according to the present invention comprises drive means for driving an elevator car; a pulse generator connected to the drive means which generates pulses, the total number of which are proportional to the travel distance of the car, computing means for computing the present position of the car by counting the number of pulses from the pulse generator, computing means for computing a predicted stop position of the car in case of power failure while the car is in motion; first memory means for storing data, which is computed by the computing means, on the predicted stop position of the car, the first memory means maintaining the data during the power failure; second memory means for storing position data on each floor on the basis of the number of pulses generated from the pulse generator; control means for controlling the drive means based on the present position of the car, and on the data which is stored in the second memory means; and computing means for correcting car position at power failure, based on the data stored in the first memory means and the second memory mean and, the present position of the car.

DESCRIPTION OF THE PREFERRED EMBODIMENTS

Figure 1:
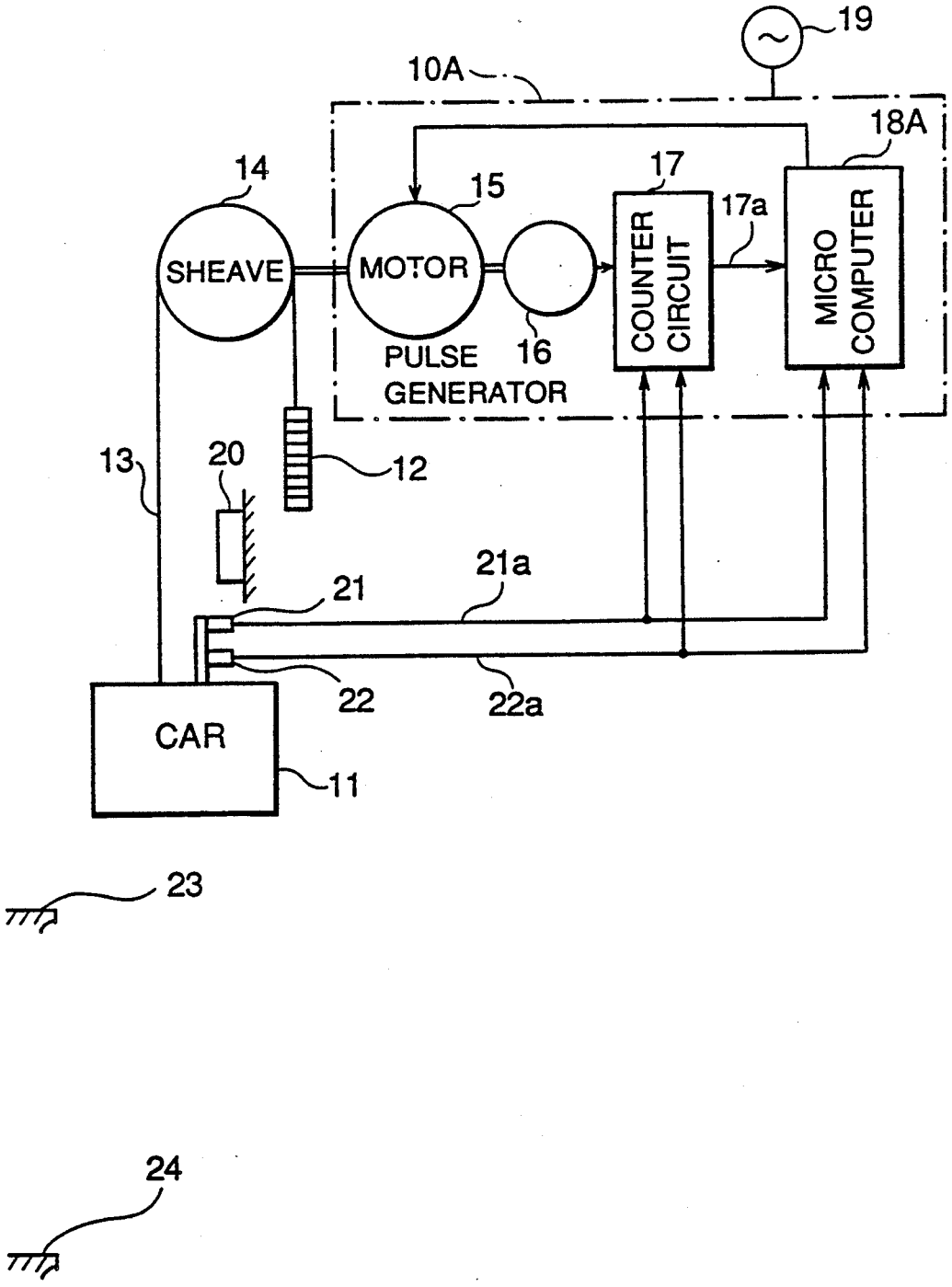
FIG. 1 is a view showing an overall elevator with the elevator control apparatus of an embodiment according to the present invention.

As shown in FIG. 1, the counterweight 12 is engaged with one end of the rope 13 and the car 11 is engaged with the other end of the rope 13. The counterweight 12 and the car 11 are suspended from the sheave 14, which is driven by the motor 15. Pulses are generated from the pulse generator 16 connected to the motor 15, and are transmitted to the counter circuit 17. The signal 17*a* is transmitted from the counter circuit 17 to a microcomputer 18A. Required power is fed from the power supply 19 to an elevator control apparatus 10A, which comprises such components as the motor 15, the pulse generator 16, the counter circuit 17 and the microcomputer 18A. Numeral 20 indicates a plate. The first position detecting device (DZD) 21 and the second position detecting device (DZU) 22 are attached to the car 11. Output signals 21*a*, 22*a* of the first and second position detecting devices 21, 22 are transmitted to both the counter circuit 17 and the microcomputer 18A. Numeral 23 indicates the fixed floor and numeral 24 indicates the bottom floor.

In such an apparatus as described above, the information about the traveling distance of the car 11 is transmitted from the sheave 14 to the motor 15 and further to the pulse generator 16. Pulses proportional to the traveling distance of the car 11 are generated from the pulse generator 16. These pulses are counted by the counter circuit 17 and transmitted to the microcomputer 18A as the signal 17*a*.

Figure 2:
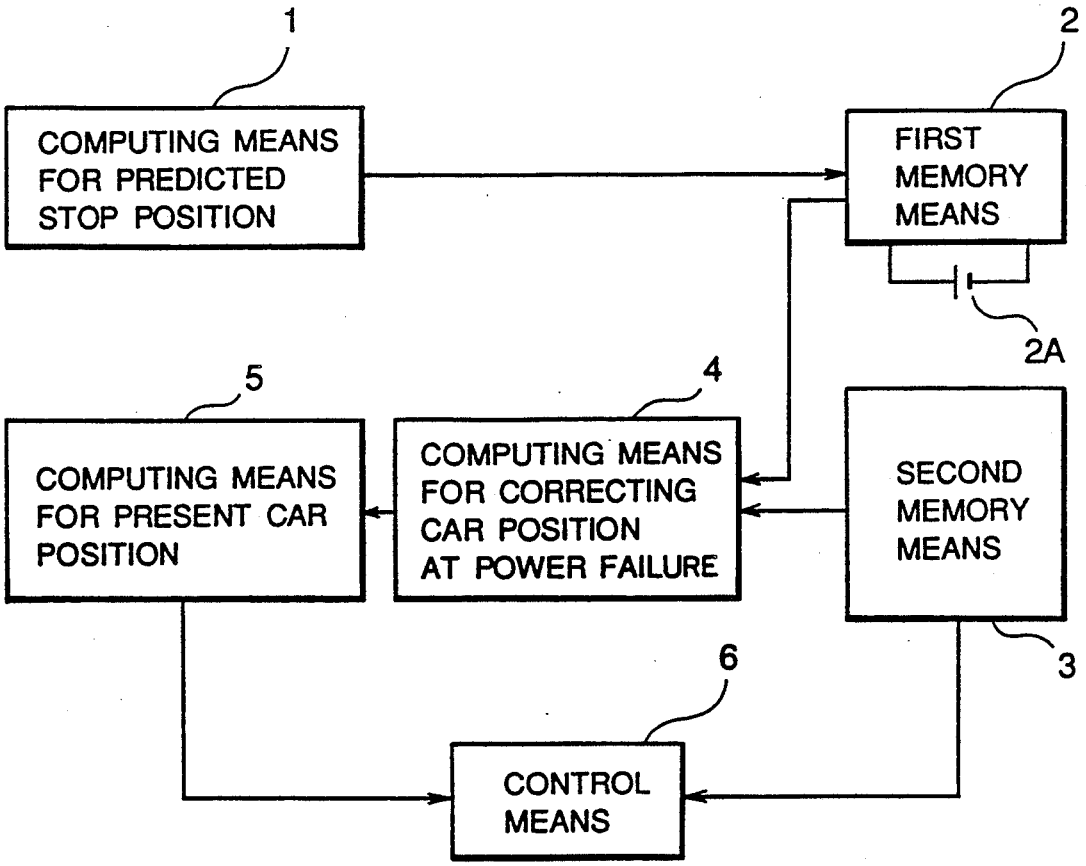
FIG. 2 is a block diagram showing the inside configuration of the microcomputer of FIG. 1.

FIG. 2 shows the inside configuration of the microcomputer 18A. A first memory means 2 and a second memory means 3 are respectively connected to a computing means for correcting car position at power failure 4. A computing means for predicted stop position 1 and a backup power supply 2A, including a battery, are connected to the first memory means 2. The computing means for correcting car position at power failure 4 is connected to a computing means for present car position 5. Further, a control means 6 for controlling the motor 15 is connected to the second memory means 3 and the computing means for present car position 5.

The computing means for predicting stop position 1 serves to compute predicted data for a stop position of the car 11. The first memory means 2 is a RAM to store the data of the predicted stop position, which is computed by the computing means for predicted stop position 1, and is supported with the backup battery power supply 2A. The second memory means 3 functions as a memory for storing the heights of floors, and is supported by the backup battery power supply 2A or other power supply. Details of the first and second memory means 2, 3 will be described later with reference to FIG. 3. The computing means for correcting car position at power failure 4 serves to correct the position of the car 11 in case of a power failure during operation of an elevator. The computing means for present car position 5 serves to compute, based on the signal 17*a* from the counter circuit 17, the present position of the car 11.

Figure 3:
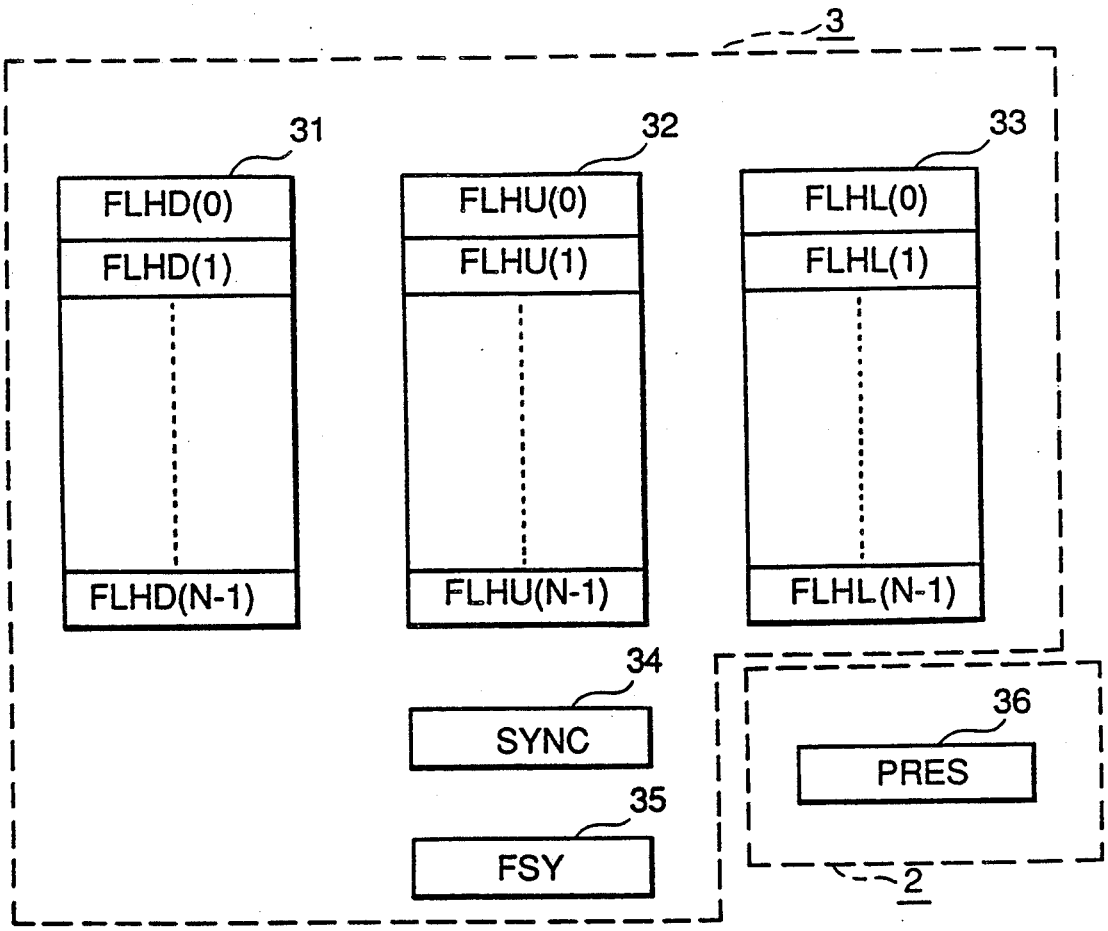
FIG. 3 is a format diagram showing partially a first and a second memory means of FIG. 2.
Figure 10:
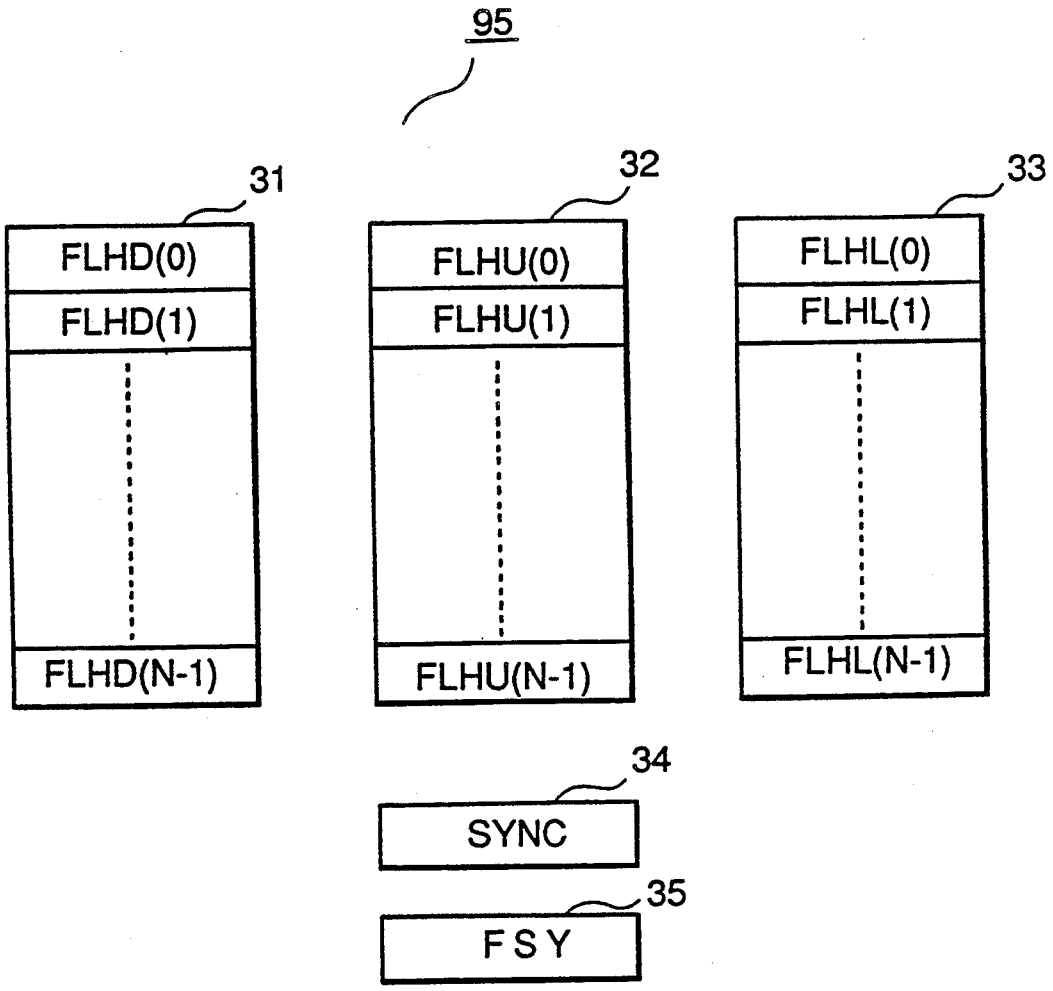
FIG. 10 is a format diagram depicting partially the RAM section of FIG. 9.
Figure 11:
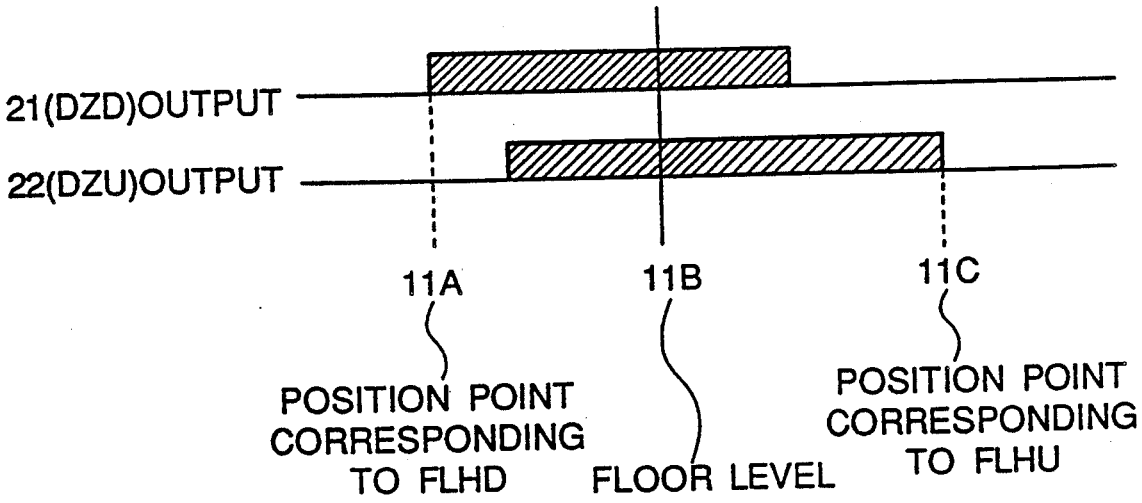
FIG. 11 is a diagram showing the correlation among a floor level, a position poiht corresponding to FLHD and a position point corresponding to FLHU.

FIG. 3 shows formats of the first and second memory means 2, 3, when a building has floors from the zero-th floor (the bottom floor) to the N−1st floor (the highest floor). The second memory means 3 has the same formats as the RAM 95 shown in FIG. 10. That is, in the case where I=0 to N−1, FLHD(I) and FLHU(I) in areas 31, 32 indicate respectively the point when the first position detecting device (DZD) 21 and the second position detecting device (DZU) 22 respond on the I-th floor. FLHL(I) in area 33 indicates an addition average between FLHD (I) in the area 31 and FLHU(I) in the area 32. SYNC and FSY in the areas 34, 35 indicate respectively the present position of the car 11 and the present floor of the car 11.

On the other hand, the first memory means 2 stores the predicted stop position of the car PRES into the area 36.

Figure 12:
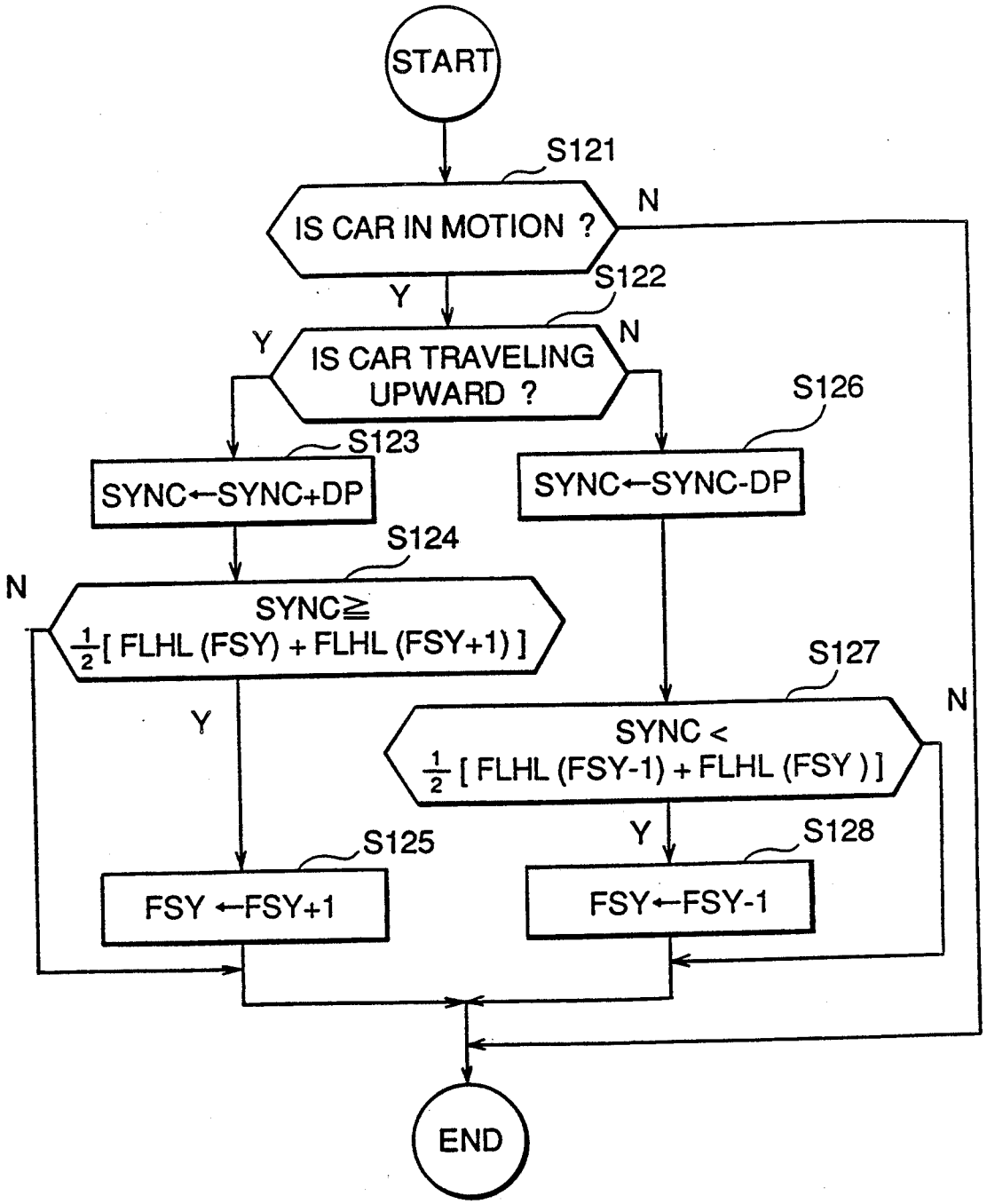
FIG. 12 is a flowchart to explain the logical steps of a program stored in the ROM of FIG. 9.
Figure 13:
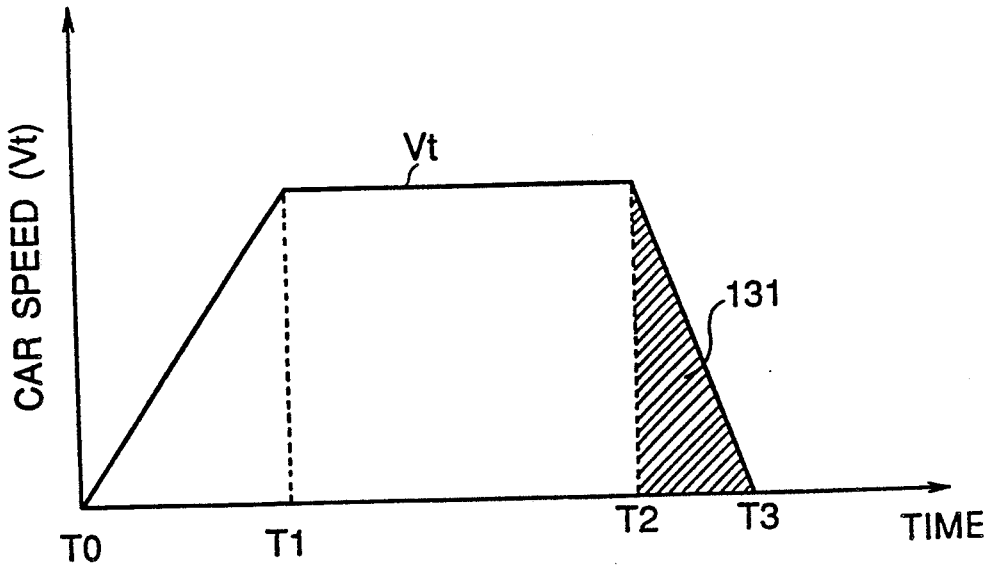
FIG. 13 is a graphical representation showing travel of the car in accordance with the conventional elevator control apparatus.

The operation of this embodiment will now be described. With the same steps as shown in FIG. 12, the computing means for present car position 5 computes the present position of the car SYNC and the present floor of the car FSY. The data from this computation is stored in the second memory means 3.

Following computation of the computation of the computing means for present car position 5, the computing means for predicted stop position 1 computes predicted data for the stop position of the car 11 if a power failure occurs. The logical steps of computing the predicted data by the computing means for predicted stop position 1 will now be described with reference to FIG. 4.

In step S41, the logical sequence, needed for the execution of a program stored in the computing means for predicted stop position 1, decides whether the car 11 is in motion or not. If the car 11 is in motion, the sequence goes down to a next step S42 to decide whether the car 11 is traveling upward or dowhward. If the car 11 is traveling upward, the sequence goes further to a next step S43 to compute the predicted stop position of the car PRES as follows:

PRES←SYNC+SL(DP)

On the contrary, if the car 11 is traveling downward in the step S42, the sequence goes to s step S44 to compute the predicted stop position of the car PRES as follows:

PRES←SYNC−SL(DP)

where, SYNC indicates the present position of the car 11 computed by the computing means for present car position 5, and DP indicates the number of pulses for each computing period (e.g. 50 ms) of the microcomputer 18A. The pulses are transmitted from the pulse generator 16 to the counter circuit 17 and further to the microcomputer 18A. SL(DP) indicates a function table with the DP as a parameter, and is stored in a fixed ROM.

Figure 5A:
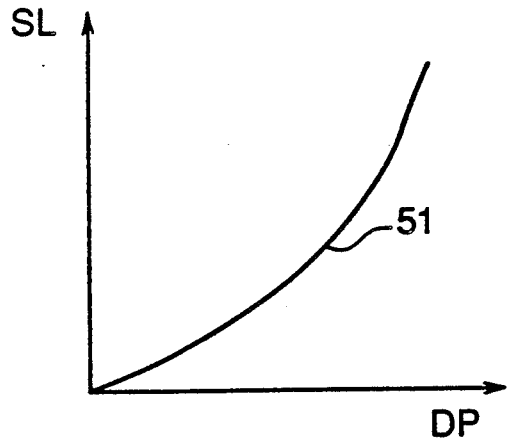
FIG. 5 is a view to help explain an SL(DP) in FIG. 4.

The DL(DP) will now be described to reference with FIGS. 5A and 5B. In FIG. 5A, as has been explained above, the DP on the horizontal axis indicates the number of pulses for each computing period of the microcomputer 18A. Therefore it corresponds to the travel speed Vt of the car 11. Whereas, the SL(DP) on the vertical axis indicates the travel distance of the car 11 during a power failure, which occurs while the car 11 is traveling with the number of pulses DP for each computing period of the microcomputer 18A.

If a power failure occurs during the travel of the car 11, the car 11 usually decelerates at constant deceleration $\beta$ because of the application of a mechanical brake in response to the power failure. The travel distance S of the car 11 during the power failure is obtained as follows:

$$S=Vt^2/2\beta \quad ([1]$$

where, Vt is the travel speed of the car 11 on the occurrence of the power failure.

Hence, when a proportional constant is K, the above formula [1] can be changed as follows:

$$SL(DP)=(/2\beta)\cdot(DP)^2 \quad [2]$$

The curve 51 in FIG. 5A is drawn based on the formula [2].

Figure 5B:
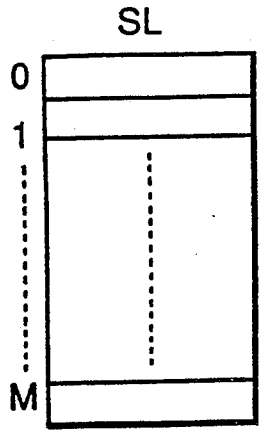

FIG. 5B shows a table where the formula [2] is stored in a tabular form into a fixed ROM.

The predicted stop position PRES thus obtained is stored in the first memory means 2.

Figure 4:
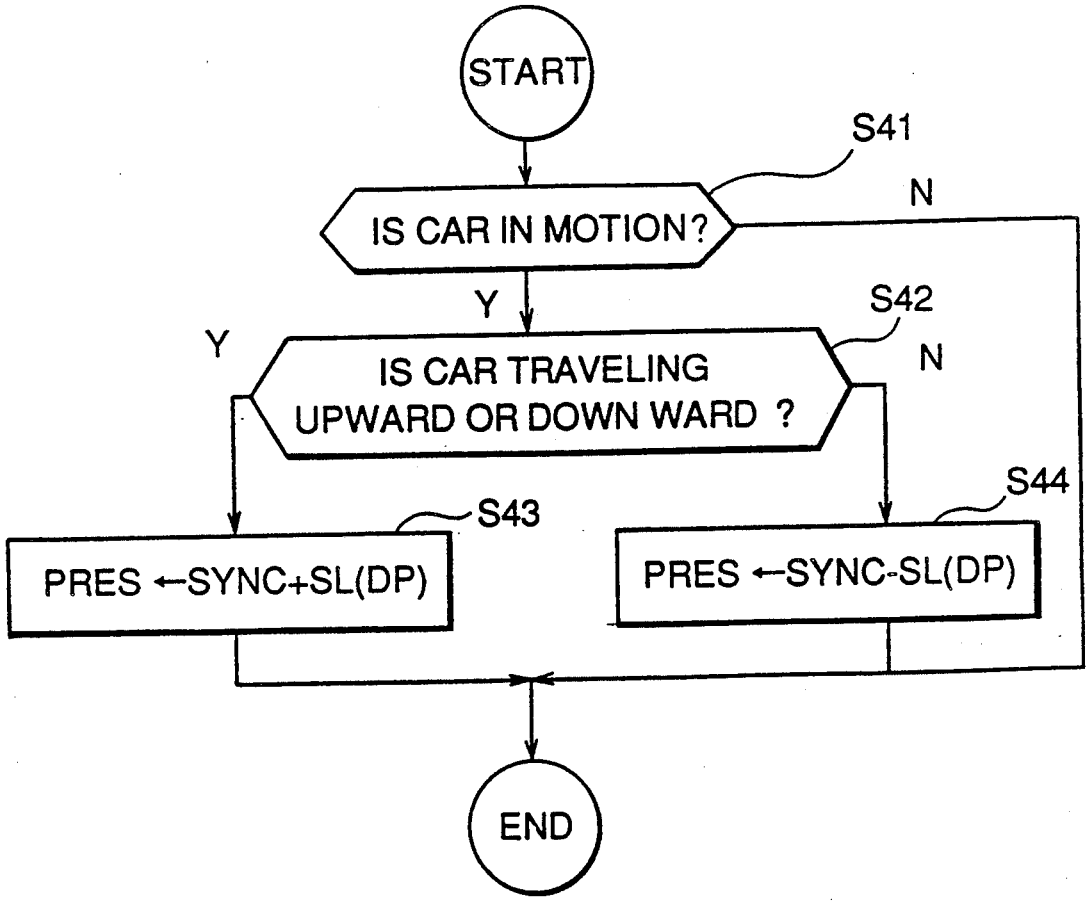
FIG. 4 is a flowchart to explain the logical steps of a computing means for predicted stop position of FIG. 2.

The computation shown in FIG. 4 for predicted stop position is always performed when power failure does not occur. This computation always updates the predicted stop position PRES in the first memory means 2. Moreover, the first memory means 2 is supported with the backup power supply 2A, so that the values of the predicted stop position PRES, stored in the first memory means 2, remain intact even after a power failure.

Figure 6:
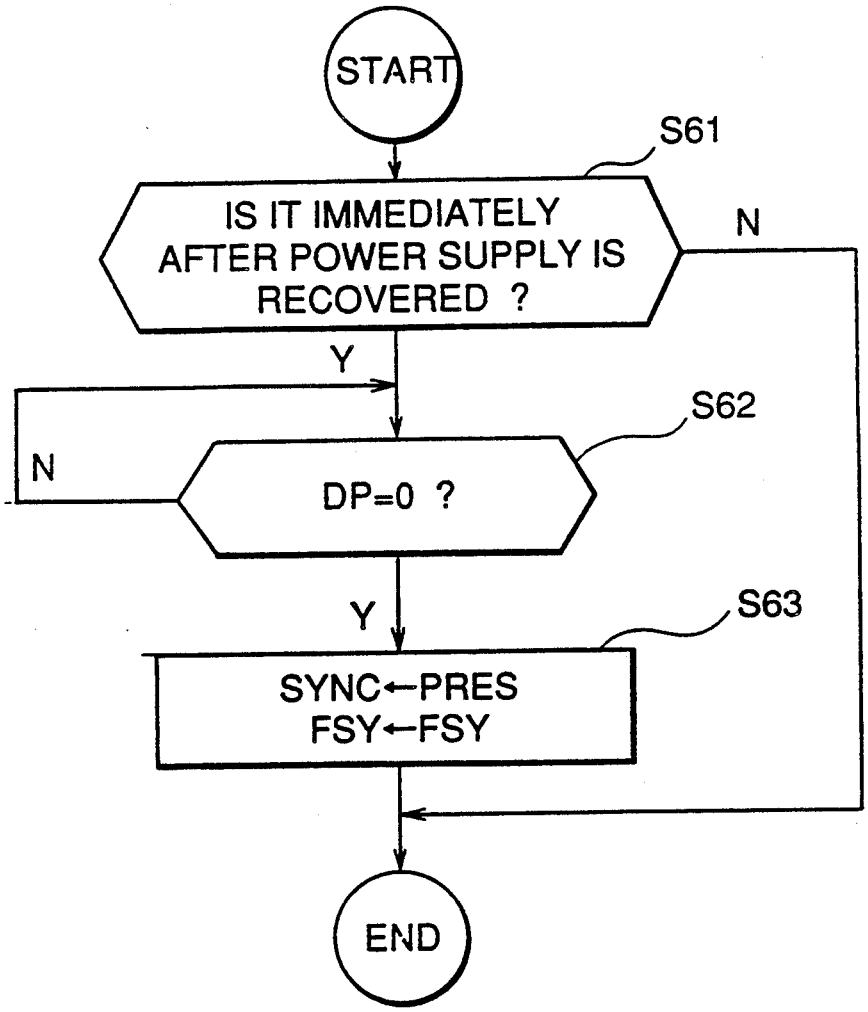
FIGS. 6 and 7 are flowcharts illustrating the logical steps of a computing means for correcting the position of the car when a power failure occurs.

The logical sequence, needed for the execution of the program, which is stored in the computing means for correcting car position at power failure 4, will now be described with reference to FIG. 6.

In step S61, the sequence decides whether or not it is immediately after the power supply is recovered. If it is immediately after the power supply recovery, the sequence goes down to a next step S62 and waits until the DP (pulses of the car travel) becomes zero. The reason for this is to avoid any errors in predicting the present position of the car 11, even if a power failure occurs and is immediately recovered while the car 11 is traveling. If the DP becomes zero, the sequence goes down to a next step S63, where the value of the predicted stop position PRES, stored in the first memory means 2, is set to the present position of the car 11 SYNC. In the step S63, the present floor of the car 11 FSY uses, without any updating, the value of the FSY, which is stored in the area 35 of the second memory means 3. That is,

SYNC←PRES

FSY←FSY

The above instructions will recover the present position of the car 11.

If the car 11 stops somewhere between floors due to the power failure, it normally travels to a nearest floor at a low speed after the recovery from the power failure. Once the car 11 stops on the nearest floor, the computing means for correcting car position at power failure 4 is performed as steps shown in FIG. 7.

In step S71, the sequence of the program, stored in the means for correcting car position at power failure 4, decides the following: is the car 11 stopped, and at the same time, is the car 11 in the [DZU DZD] zone of the second position detecting device DZU 22 and the first position detecting device DZD 21?

When the car 11 is in the [DZU DZD] zone, this means that the car 11 is in a position where the car door can be opened and closed. This also means passengers can get in and out of the car. Restart of the car from this position allows a normal high-speed run. In other words, when the car 11 is in the [DZU DZD] zone, the normal operation service of the elevator is available.

In the step S71, if the car 11 is in the [DZU DZD] zone, the sequence of the program goes down to a next step S72. ||SYNC-FLHL(I)|| is compared with each I, where I=0 to N−1, by the use of the SYNC and FLHL(I) in the second memory means 3. A floor I, where the absolute value of the comparison becomes the minimum value, is determined and set as the present floor FSY. Further, the memory value FLHL(FSY) of the floor. height corresponding to this present floor FSY is set to the present position SYNC. That is, after a low-speed automatic run of the car, from the floor height memory, the closest floor to the car 11 is updated as the FSY and the floor position of this closest floor is updated as the SYNC.

The travel distance of the car 11, at the low-speed automatic run after the power failure, corresponds to the value obtained by the computing means for present car position shown in FIG. 12.

In case of a power failure while the car 11 is traveling, the predicted position PRES, where the car 11 is predicted to stop, is previously determined. The predicted stop position PRES, however, may not precisely agree with an actual stop position of the car 11, owing to the fact that the deceleration by a mechanical brake is not constant because of changes and the like of the friction coefficient. This necessitates compensation for thus generated errors.

As has been described, this embodiment permits easy and accurate correction to the present position and floor of the car 11, without the car 11 being forced to travel to a standard floor, even after a power failure occurs while the car 11 is traveling. This embodiment also eliminates a large-scale backup power supply to support the power supply of the entire control device in the event of the power failure.

Although in this embodiment as indicated in the formula [2], the travel distance SL of the car 11 during a power failure is determined as the function of the number of pulses DP for each computing period of the microcomputer 18A, a standard speed command value PAT, instead of the number of pulses DP, can also be applied. The elevator car usually travels based on the deviation between the standard speed command value PAT and the actual speed of the car. The car travels under the control of the feedback of the deviation. Since the standard speed command value PAT can be obtained from the required operation of the microcomputer, it may be utilized directly from the microcomputer.

Figure 7:
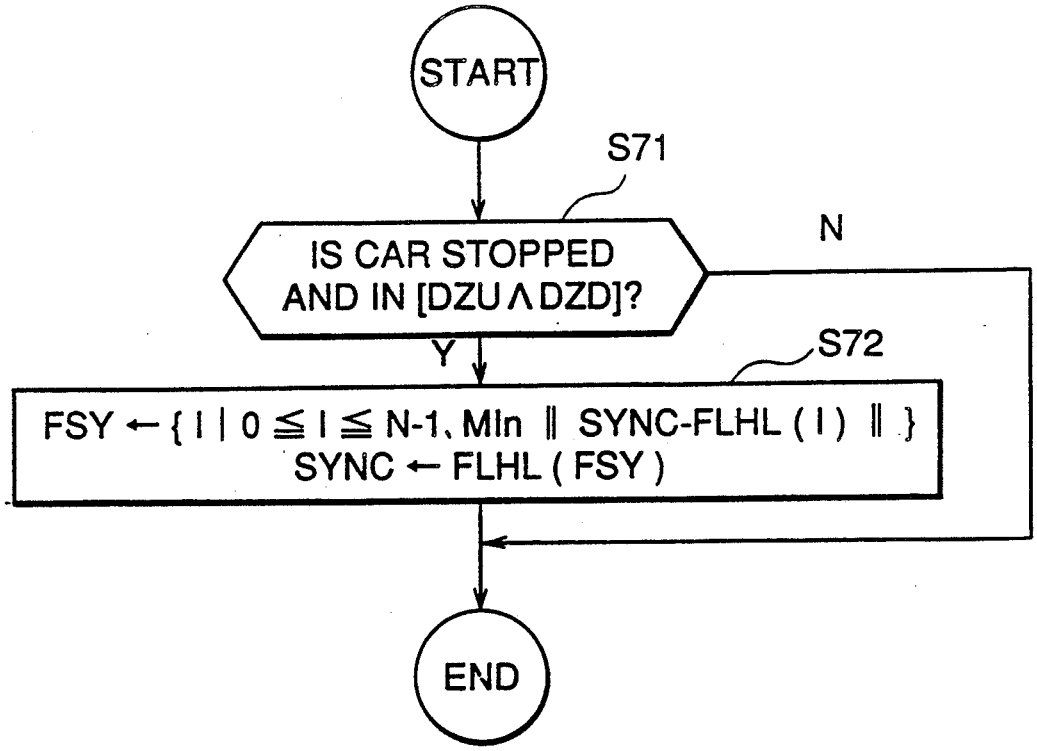
Figure 8:
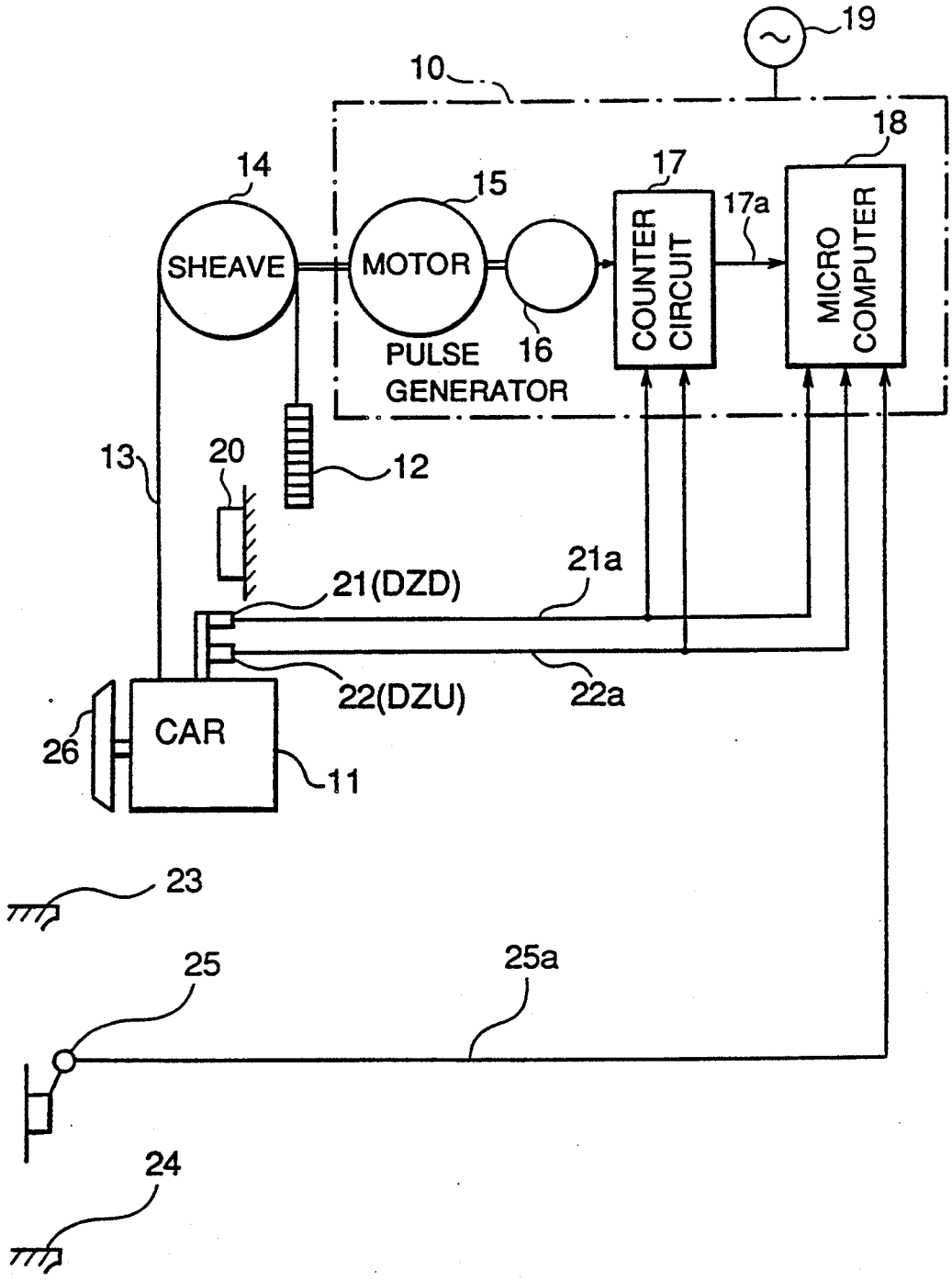
FIG. 8 is a view showing an overall elevator with the conventional elevator control apparatus.
Figure 9:
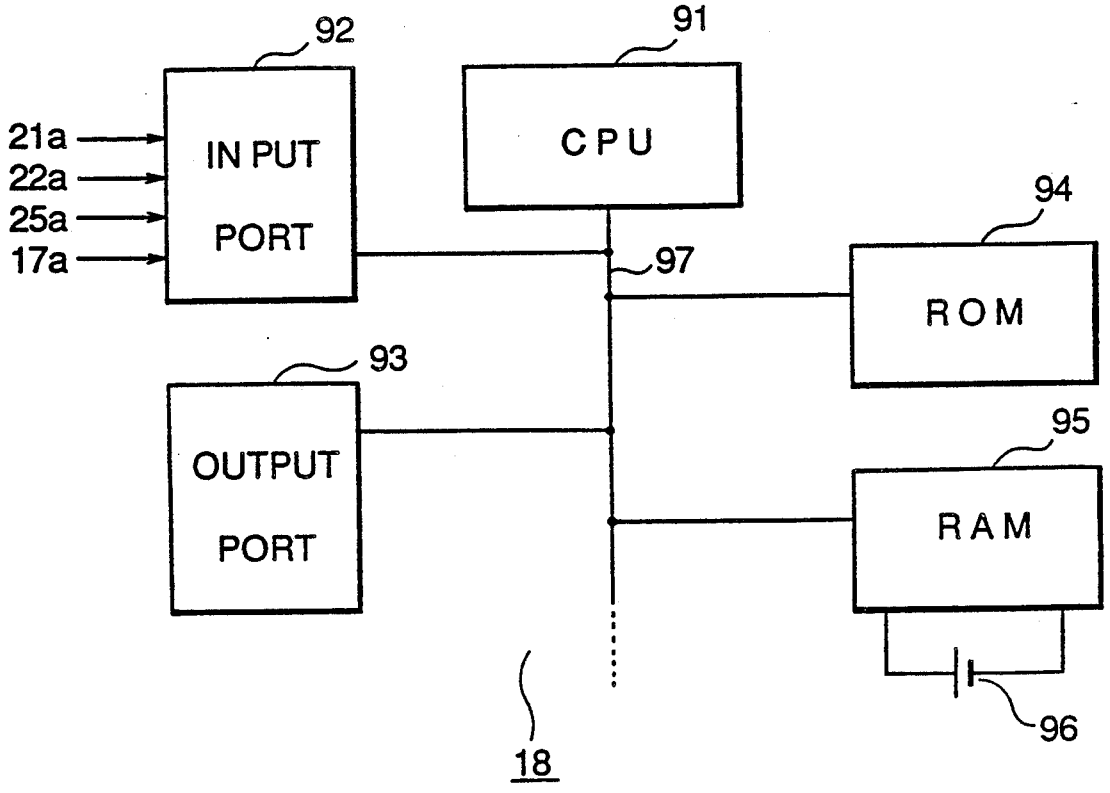
FIG. 9 is a block diagram illustrating the inside configuration of the microcomputer of FIG. 8.

In FIG. 7, although the present position and floor of the car are corrected after the completion of a slow-speed automatic run, they may be corrected even during an automatic run. That is, while the car is traveling automatically at a slow speed, leading of the DZU or DZD signal is detected by the use of the signal from the second position detecting device DZU or the first position detecting device DZD, so that modifications can be made as follows:

$$FSY \leftarrow \{I \mid O \leqq I \leqq N-1, \mathrm{Min} \mid |SYNC - FLHU(I)| \mid\}$$

or $$FSY \leftarrow \{I \mid O \leqq I \leqq N-1, \mathrm{Min} \mid |SYNC - FLHD(I)| \mid\}$$

$$SYNC \leftarrow FLHU(I)$$

or $$SYNC \leftarrow FLHD(I)$$

Furthermore, the more detailed relation between the SL and DP in FIG. 5 may be determined. That is, the travel distance S of the car, including the dead time of the brake td during the power failure, can be obtained as follows:

$$S = Vt^2 + Vtd$$

The delay time of the control system of the elevator during acceleration and deceleration of the elevator can also be included.

If the number of power failures during the travel of the car exceeds a predetermined allowed number, the car is forced to travel to a standard floor (for example, the bottom floor). On the standard floor, the data about the present position and floor of the car, in correspondence to the standard floor, can also be updated again in the memory.

The invention has been described in detail with particular reference to the preferred embodiment thereof, but it will be understood that variations and modifications of the invention can be made within the spirit and scope of the invention.

What is claimed is:

1. An elevator control apparatus comprising:

drive means for driving an elevator car;

a pulse generator connected to said drive means for generating a selected number of pulses, the selected number being proportional to the travel distance of the car;

computing means for computing present position of the car by counting the number of pulses from said pulse generator;

computing means for computing a predicted stop position of the car in case of power failure while the car is in motion;

first memory means for storing data which is computed by said computing means for predicting stop position, said first memory means retaining the data during power failure;

second memory means for storing data indicative of the present position of the car computed on the basis of the number of pulses generated from said pulse generator;

control means for controlling said drive means based on the present position of the car and based on the data which is stored in said second memory means; and computing means for correcting a parameter indicative of car position at power fialure upon recovery from power fialure, based on the data stored in said first and second memory means and the present position of the car.

2. An elevator control device according to caim 1, wherein said computing means for correcting car position at power failure treats the data which is computed by said computing means for predicted stop position predicted stop position, as data indicative of the present position of said car.

3. An elevator control device according to claim 1, wherein, when the car stops between floors due to power failure, said control means causes said car to travel to the closest floor after recovery from power failure where said computing means for correcting car position upon power failure treats the position of the closest floor as the present position of the car.

4. An elevator control device according to calim 1, wherein said computing means for present car position also computes the present floor of said car.

5. An elevator control device according to claim 1, wherein said first memory means includes a memory and a battery power supply for backup of said memory.

* * * * *

UNITED STATES PATENT AND TRADEMARK OFFICE

CERTIFICATE OF CORRECTION

PATENT NO. : 5,085,294

DATED : FEBRUARY 4, 1992

INVENTOR(S) : SHIGEMI IWATA

It is certified that error appears in the above-identified patent and that said Letters Patent is hereby corrected as shown below:

Claim 1, column 10, lines 34 & 35, change "fialure" to --failure-

Claim 2, column 10, line 42, delete "predicted stop position" (2nd occurrence).

Signed and Sealed this

Thirteenth Day of April, 1993

*Attest:*

STEPHEN G. KUNIN

*Attesting Officer*

*Acting Commissioner of Patents and Trademarks*